US006250385B1

(12) United States Patent
Montaron

(10) Patent No.: US 6,250,385 B1
(45) Date of Patent: Jun. 26, 2001

(54) METHOD AND APPARATUS FOR COMPLETING A WELL FOR PRODUCING HYDROCARBONS OR THE LIKE

(75) Inventor: Bernard A. Montaron, Dubai (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/107,041

(22) Filed: Jun. 29, 1998

(30) Foreign Application Priority Data

Jul. 1, 1997 (FR) ..... 97 08276

(51) Int. Cl.[7] ..... E21B 17/00

(52) U.S. Cl. ..... 166/207; 166/217; 166/230; 166/242.1; 405/150.1

(58) Field of Search ..... 166/206, 207, 166/217, 230, 233, 242.1, 277; 405/150.1

(56) References Cited

U.S. PATENT DOCUMENTS

| | | | | |
|---|---|---|---|---|
| 341,327 | * | 5/1886 | Fay | 166/207 |
| 1,620,412 | * | 3/1927 | Tweeddale | 166/203 |
| 1,981,525 | * | 11/1934 | Price | 166/193 X |
| 2,583,316 | * | 1/1952 | Bannister | 166/207 X |
| 2,812,025 | | 11/1957 | Teague et al. . | |
| 5,040,283 | | 8/1991 | Pelgrom . | |
| 5,119,862 | * | 6/1992 | Maimets et al. | 405/150.1 X |
| 5,186,215 | | 2/1993 | Gilleland . | |
| 5,348,095 | | 9/1994 | Worrall et al. . | |
| 5,366,012 | | 11/1994 | Lohbeck . | |
| 5,725,026 | * | 3/1998 | Maimets | 405/150.1 X |
| 5,725,328 | * | 3/1998 | Schmager | 405/150.1 X |
| 5,901,789 | * | 5/1999 | Donnelly et al. | 166/207 |

FOREIGN PATENT DOCUMENTS

| | | |
|---|---|---|
| 2 172 370 | 3/1985 | (GB) . |
| WO 93/25800 | 12/1993 | (WO) . |
| WO 96/22452 | 7/1996 | (WO) . |
| WO 97/17565 | 5/1997 | (WO) . |

OTHER PUBLICATIONS

French Search Report No. 9708276000 DU Jan. 7, 1997.

* cited by examiner

*Primary Examiner*—George Suchfield
(74) *Attorney, Agent, or Firm*—Gordon G. Waggett; Robin C. Nava

(57) ABSTRACT

The invention relates to an expandable liner for completing a hole in an underground formation, the liner being constituted by a spiral-wound strip with the longitudinal edges of the strip having complementary touching profiles so that after it has been expanded, the liner is circular in section. The invention also provides a method of completing a well finally or temporarily by installing a spiral-wound liner of the invention, expanding it, and optionally cementing it.

9 Claims, 5 Drawing Sheets

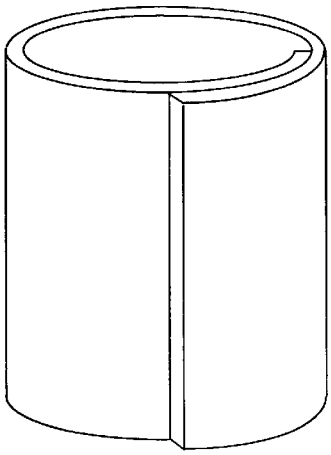
Fig. 1a
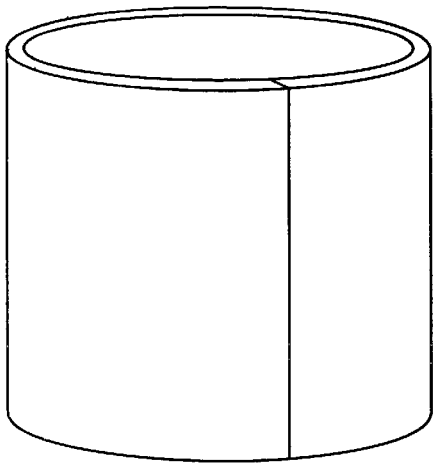
Fig. 1b
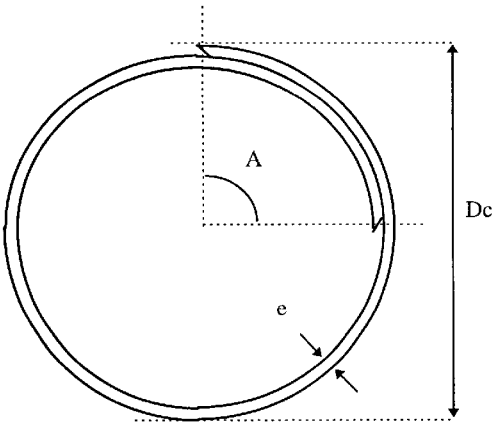
Fig. 1a'
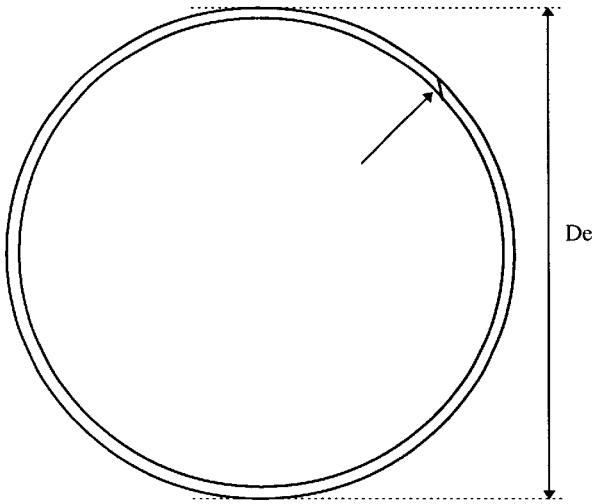
Fig. 1b'
FIGURE 1

FIGURE 6
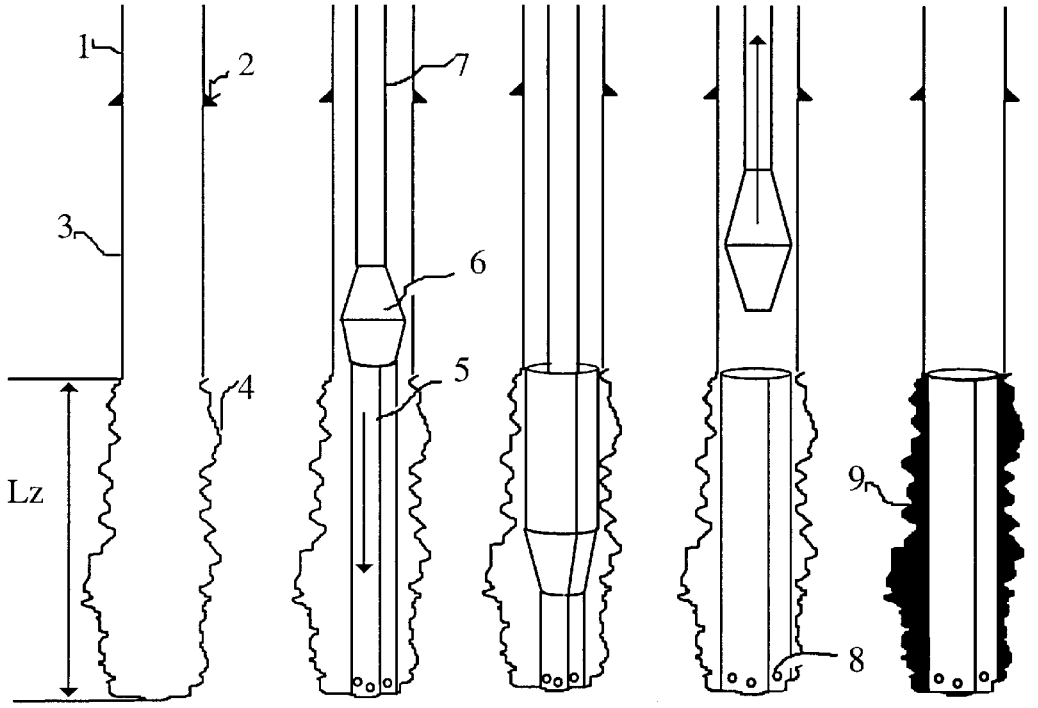
Fig. 6a Fig.6b Fig. 6c Fig. 6d Fig. 6e
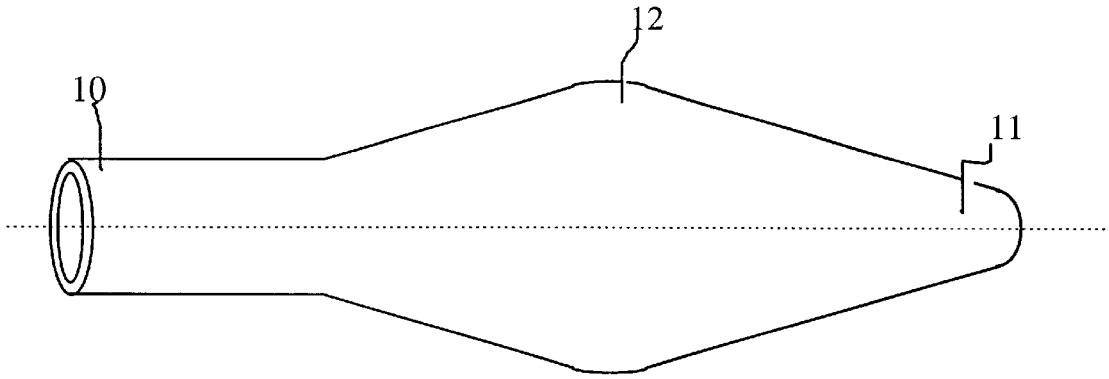
FIGURE 2

FIGURE 4
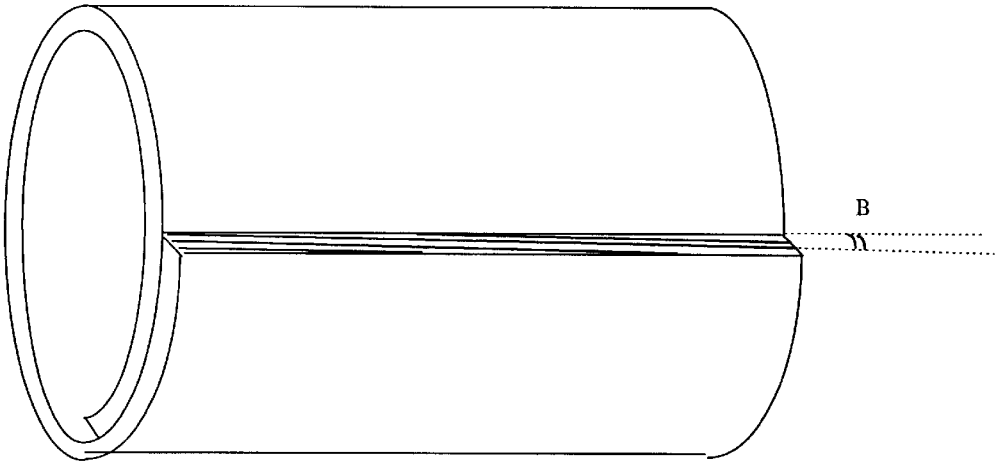
FIGURE 5
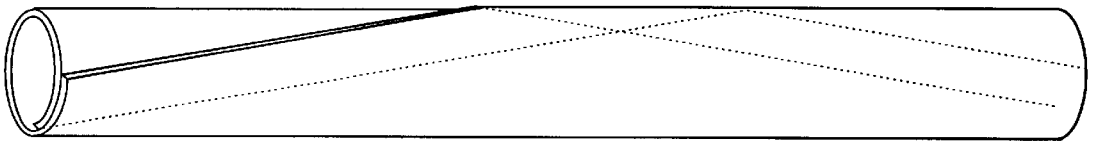
Fig. 5a
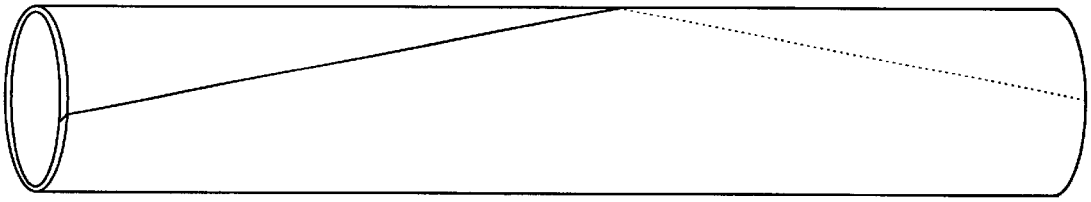
Fig. 5b
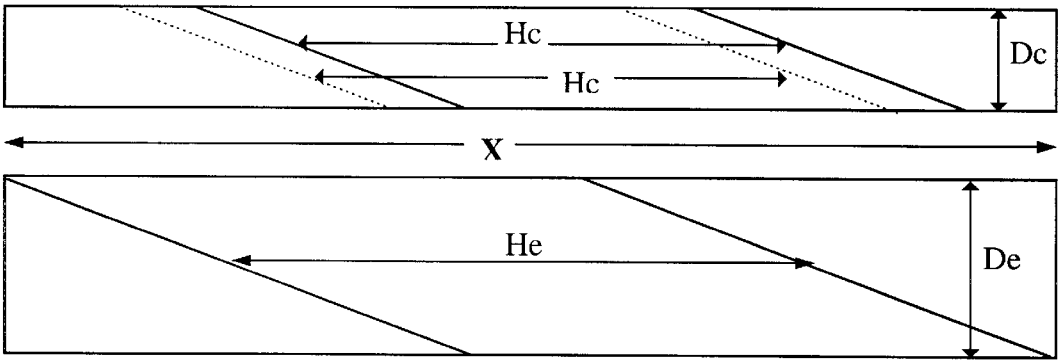
Fig. 5c FIGURE 7
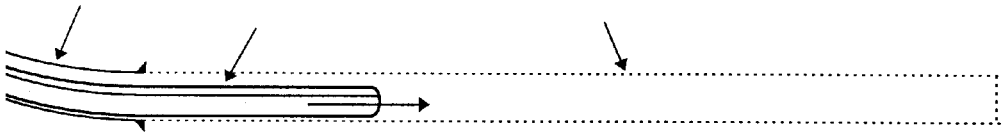
FIG. 7A
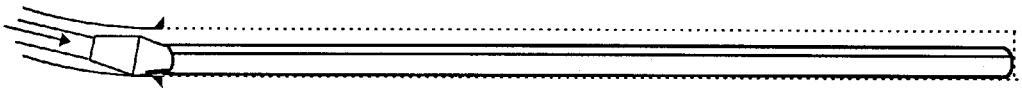
FIG. 7B
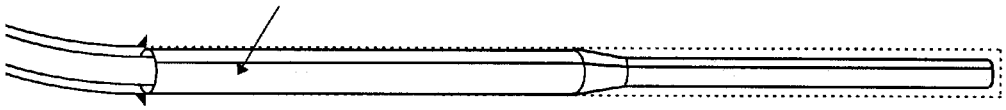
FIG. 7C
FIGURE 8
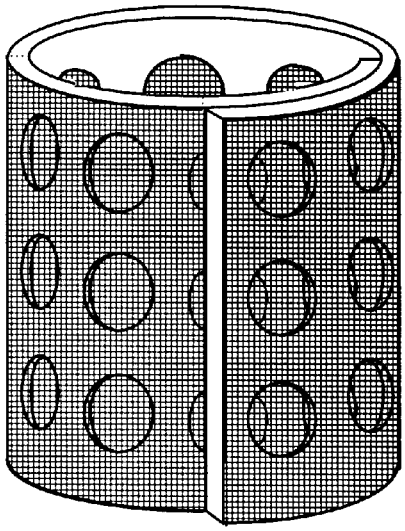

METHOD AND APPARATUS FOR COMPLETING A WELL FOR PRODUCING HYDROCARBONS OR THE LIKE

BACKGROUND OF THE INVENTION

The invention relates to the field of petroleum service and supply industries, and more particularly to completing wells for producing hydrocarbons, geothermal wells, or the like.

While drilling is taking place, the integrity of a well is controlled by a drilling mud of density that needs to be adjusted so that the hydraulic pressure of the mud column opposes the leaks from the formations while simultaneously avoiding damaging the underground formations by fracturing them. When the drilled depth exceeds a certain value, the pressure difference due to the difference in depth is such that it is no longer possible to formulate a mud capable of performing its function over the entire length of the well, so to prevent collapse of the wall, it is necessary to line the hole with metal casing. For this purpose, a certain number of casing tubes are placed end to end and lowered down the well, and are fixed to the wall of the well by cementing. Thereafter, drilling can continue down to the next critical depth.

Each newly-drilled length must be lined with casing of outside diameter that is small enough to pass through the casing that is already in place at shallower depths. As a result the casing has a staircase structure with a hole that is large at the top of the well and much narrower at the bottom of the well. Such a configuration is far from optimal: a large hole at the surface means that drilling time must be wasted in a non-productive zone, whereas a narrow hole in the useful zones does not favor production by good draining of the formation.

Worse still, it often happens that the hole passes through unexpected critical zones even before boring has reached a critical depth. Such critical zones may, for example, be veins of very friable rock or "pockets" of gas which, even though they are usually very localized, constitute major sources of danger both for the well and for the work force on the surface. Under such circumstances, the only solution is often to cement these zones by putting casing into place immediately, thereby further reducing the size of the hole, which can lead to a well being abandoned if further difficult zones are encountered as drilling continues.

It will also be understood that it is very difficult to repair damaged casing by installing new casing, without further significantly reducing the size of the hole and thus running the risk of preventing penetration of certain tools or items of equipment that may be needed in the production zones, for example.

Over the last few years, the industry has developed new techniques of completing wells or of completing them temporarily, so as to minimize the number of "steps" and to increase the downhole diameter of the well.

Proposals have thus been made to use a composite material comprising an expandable cloth made of glass fibers impregnated with non-polymerized epoxy resin and having a rubber membrane covering its outside face which is directed towards the wall of the hole. By using an appropriate laying tool, the membrane is applied against the wall of the hole or a damaged portion of casing, and the resin is caused to polymerize by being heated. The main difficulty of that technique is that it requires electrical power of the order of 1000 watts per linear meter, thus limiting its application to treating zones that are relatively short. In addition, such a casing of synthetic material cannot constitute a final replacement for metal casing since that needs to be capable, in particular, of withstanding treatments based on strong acids or other materials that are particularly corrosive.

US patent U.S. Pat. No. 5,348,095 proposes making casing out of a continuous tube of ductile material capable of withstanding large amounts of plastic deformation. The tube is enlarged by a conical tool, and it can optionally be cemented. However, expansion of the tube is accompanied by a reduction in the total length of the tube, and this can give rise to interface problems at the ends. Furthermore, the pressure required for expanding the tube is very high.

Patent U.S. Pat. No. 5,366,012 proposes a perforated liner provided with overlapping longitudinal slots. A mandrel having a large diameter that is greater than the inside diameter of the perforated liner is used to expand the wall of the liner and the orifices become larger. Fiber-reinforced cement can then be cast on either side of the liner, and once the cement has set, the inside of the liner is bored again, thereby leaving a casing of fibro-cement that is reinforced by metal reinforcement. The need for further boring after cementing constitutes a major drawback of that technique. In addition, in the above-mentioned case, the pressures required for expanding the tube are quite high and the final length of the liner is reduced. Finally, the slots must be pierced in compliance with very precise specifications, which leads to a manufacturing cost that is high.

An object of the present invention is a novel type of expandable casing that does not present the above-mentioned drawbacks of the art.

SUMMARY OF THE INVENTION

According to the invention, this object is achieved by a liner for completing a hole in an underground formation, the liner being constituted by a spiral-wound strip of spiral cross-section, its longitudinal edges having complementary touching profiles such that after expansion the liner is circular in section.

To complete a well, the spiral tube is lowered to the bottom of the hole and its walls are spread by means of a placement tool, e.g. a conical tool, so as to place the longitudinal edge in a touching position where they form a cylinder. A closed continuous liner is thus obtained which can be cemented in conventional manner without the cement invading the inside of the liner, and thus without there being any need to bore inside the casing. It should be observed that the spiral-wound casing of the invention is particularly adapted to cementing wells that are horizontal or multilateral, given its small diameter in its contracted state which lends itself well to being installed in narrow wells or in wells of trajectory that impedes the lowering of traditional casing segments.

The liner of the invention is also well adapted to provisionally completing problem zones. In any event the hole may optionally be enlarged in the difficult zone and a spiral liner whose diameter after expansion is close to the diameter of the hole before enlargement may then be put into place and cemented. Thereafter, drilling can continue and the entire column, including the zone that has already been completed, is subsequently completed in conventional manner.

The spiral casing of the invention can also be used for repairing casing that has been damaged, since the outside diameter of the spiral casing after expansion can be selected to be equal to or very slightly less the inside diameter of the casing that is already in place.

The spiral-wound strip preferably has chamfered longitudinal edges that define contact surfaces whose general direction lies in a plane which forms a non-zero angle relative to the longitudinal axis of the liner. Also preferably, the longitudinal edges have a crenellated section to provide mechanical engagement at a predetermined diameter.

In a more particularly preferred variant of the invention, the liner is obtained by rolling up a strip about an axis that is at a certain angle relative to the axis of symmetry of the strip. Under such circumstances, when the liner is in the contracted state, it has edges which form a double helix around the cylinder. If the period of the helix is appropriately chosen, then a geometrical figure is obtained whose length is not altered by expansion.

The liner of the invention can be wound lengthwise on a drum, using the techniques known for coiled tubing. In order to complete sections that are of great length, it is possible to weld together a plurality of sheets, either during manufacture of the liner, which is preferable when using the coiled tubing technique, or else directly on site. The liner of the invention can be made of metal, e.g. steel or any other material having the desired degrees of elasticity and plasticity. It should be observed that if a highly elastic material is selected, and providing it has not been cemented, then the liner of the invention can optionally be removed, thus making temporary placements possible.

Other details and advantageous characteristics of the invention appear from the following description given with reference to the figures, in which:

BRIEF DESCRIPTION OF THE DRAWINGS

FIG. 1 is a diagrammatic view of a first embodiment of a liner of the invention before and after expansion, shown in perspective (FIGS. 1*a* and 1*b*) and in end view (FIGS. 1*a*' and 1*b*');

FIG. 2 shows an expansion tool;

FIG. 4 is a perspective view of a liner in the contracted state and having longitudinal edges with toothed sections;

FIG. 5 shows a liner of the invention having longitudinal edges constituting a double helix, seen in perspective in the contacted state (FIG. 5*a*), after expansion (FIG. 5*b*), and in longitudinal section (FIG. 5*c*);

FIG. 6 shows an example of temporary completion (FIGS. 6*a* to 6*e*) using a liner of the invention;

FIG. 7 shows a typical sequence (FIGS. 7A to 7C) for completion of a production zone; and FIG. 8 shows a variant of a liner of the invention that is perforated and fitted with a sand screen.

DETAILED DESCRIPTION

The concept of the invention is shown in FIG. 1. A strip, e.g. a metal strip, is spiral-wound (FIGS. 1*a* and 1*a*') with overlap over an angle A. After expansion, the liner is circular in section and its longitudinal edges come into contact to constitute a closed peripheral surface.

If the winding follows an Archimedes' spiral, then writing e for the thickness of the strip and Dc for the pseudo-diameter of the spiral-wound strip in the contracted state, the value De of the diameter after expansion is given by the following equation:

$$De = Dc\left(1 + \frac{A}{2\pi}\right) - \left[\frac{1}{2} + \frac{3A}{4\pi} + \left(\frac{A}{4\pi}\right)^2\right]e$$

where A, the overlap angle, is expressed in radians, and where the lengths De, Dc, and e are expressed in the same units.

With an overlap of 90° as shown in FIG. 1*a,* a liner having an outside diameter De of 17.8 cm (7") and a thickness e of 9.5 mm (⅜ of an inch) is contracted to a diameter Dc of 14.9 cm (5.86"). For an overlap of 180°, the expansion is close to 50%.

By way of example, the tool for expanding the liner of the invention can be constituted by a double cone assembly as shown diagrammatically in FIG. 2, having a first end 10 suitable for being fixed to the end of a coiled tube or of a string of rods, and a second end 11 of diameter similar to that of the spiral-wound liner in the contracted state, thereby enabling the spiral-wound liner to be pushed to the zone which is to be completed. The expansion tool also includes an enlarged zone 12 of outside diameter close to the inside diameter of the liner after it has been expanded. The enlarged zone 12 is preferably capable of being retracted at least in part by remote control means such as hydraulic pressure, mechanical means, or a combination of such means as is conventional for placement tools as used in wells. The tool for withdrawing the liner of the invention can also be constituted by a double cone assembly as shown in FIG. 2 where the enlarged zone 12 is further expanded such that the outside diameter of the tool is greater than the inside diameter of the liner at which the liner comprises a circular section.

Figure 3A:
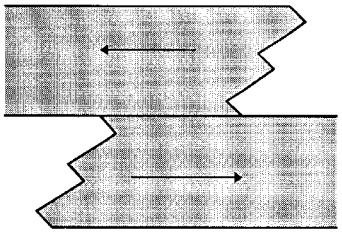
FIG. 3 shows an example of mechanical engagement using toothed edges (FIGS. 3*a* to 3*e*) and shows various profiles for such toothed edges.
Figure 3B:
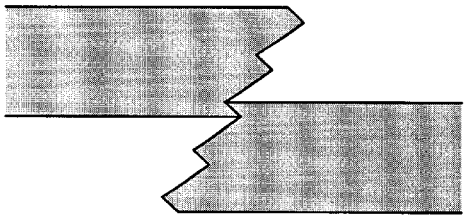
Figure 3C:
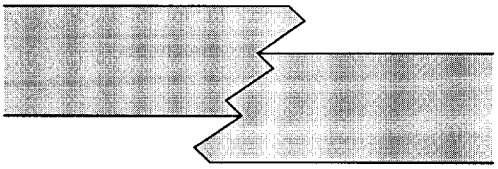
Figure 3D:
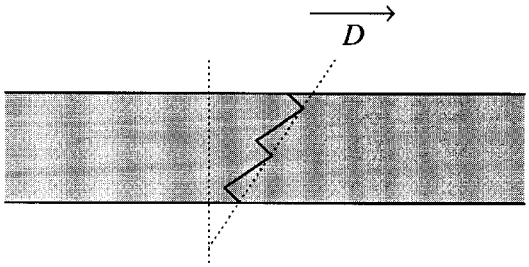
Figure 3E:
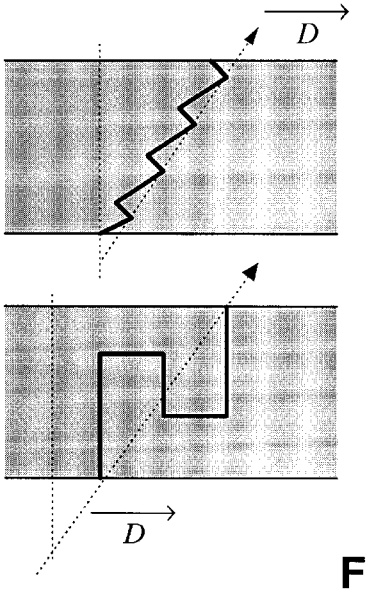
Figure 3:
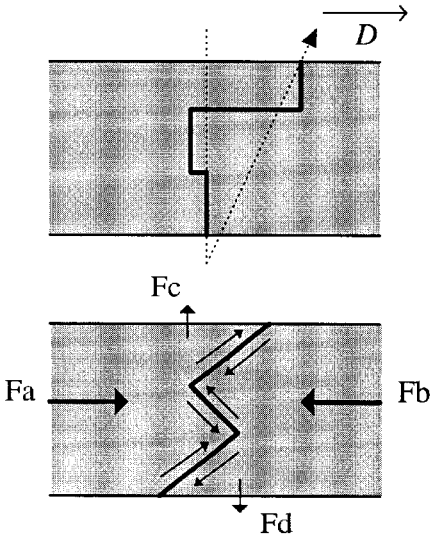

In the variant of the invention shown in FIG. 3, the complementary longitudinal edges are given teeth so as to form a mechanical lock. As can be seen more particularly in FIGS. 3*a* to 3*d,* a toothed edge, in this case an edge having three teeth, can provide effective engagement. It may also be observed that the longitudinal edges have a contact area facing in a general direction $\vec{D}$ at a non-zero angle relative to the normal to the longitudinal axis of the liner. An angle of about 45°, and more generally lying in the range 30° to 60° is generally preferred.

Other variant toothed profiles are shown in FIG. 3*e.* The number of teeth can be increased, or on the contrary, decreased, and it is possible to select profiles that are nearer to being square so as to achieve engagement that is closer to being of the tenon and mortise type. In all of the examples shown in FIG. 3, the toothed edges follow a general direction $\vec{D}$ at a certain angle relative to the normal to the longitudinal axis of the liner. The profile selected is preferably such as to minimize radial friction forces that tend to oppose sliding of the two complementary portions. As shown in FIG. 3*e,* the elastic forces Fa and Fb that result from expanding the spiral-wound liner create radial friction forces Fc and Fd which tend to move the edges apart. This separation force can be minimized or even eliminated by optimizing the shape of the teeth.

The forces Fa and Fb which assist in locking the liner are directly proportional to the overlap angle A of the liner in the contracted position. Nevertheless, too much overlap also tends to increase the radial forces so that a balance must be found between the desired coefficient of expansion and mechanical locking.

The liner is expanded into the shape of a cone of dimensions that depend essentially on the geometry of the spiral-wound liner and on its elasticity, and to a smaller extent on the apex angle of the conical expansion tool. To limit friction forces, it may be advantageous to select an expansion tool constituted by a cone whose apex angle is close to that of the "natural" expansion cone of the spiral-wound liner.

As shown more particularly in FIG. 4, the axis of the engagement teeth forms an angle B with the axis of the spiral-wound tube. This angle B has an optimum value lying between the "natural" expansion cone angle of the liner and zero, however zero is also acceptable.

FIG. 5 shows the most particularly preferred variant of the invention in which the liner is obtained by rolling up a strip about an axis that is at a certain angle relative to the axis of symmetry of the strip. In the contracted position (FIG. 5*a*), the edges form a double helix around the liner. After expansion (FIG. 5*b*), the two helixes coincide and the junction line winds helically around the liner.

A particularly advantageous aspect of this geometry lies in it being possible for expansion to be performed without changing the X length of the liner. If, as shown in FIG. 5*c*, the "diameters" of the liner are written Dc and De (where index c corresponds to the liner being in the contracted state and index e to the liner in the expanded state), and if the periods of the helical curves followed by the longitudinal edges are written Hc and He (where the period of a helix is defined as being the distance measured along the longitudinal axis of the liner between two corresponding points that are one complete turn apart around the cylinder of diameter Dc (or De if the case may be)), and if the length of a longitudinal edge of the liner is written L for a liner whose total length is X, it can be shown that the length L is equal to:

$$L = X\sqrt{1+\left(\frac{\pi D}{H}\right)^2}$$

and that consequently, if the tape is rolled up in such a manner that $$\frac{D_e}{H_e} = \frac{D_c}{H_c},$$

then the length X does not vary.

With this double helix configuration, it should also be observed that if the strip constituting the liner is of thickness W, then the diameter after expansion is given by the equation:

$$D_e = \frac{WL}{\pi X}.$$

Finally, another consequence of this geometry is that all points on the surface of the liner move in a plane perpendicular to the axis of the liner during the expansion stage. If the ends of the double helix liner are cut perpendicularly to the longitudinal axis, then after expansion these ends will define perfect circles in plane that are themselves perpendicular to the longitudinal axis of the liner. This disposition is particularly favorable for ensuring sealing of the completion at the ends of the liner.

FIGS. 6 and 7 are highly diagrammatic and show two examples of completion using a spiral-wound liner of the invention, it being understood that these examples are not limiting in any way.

In the example shown in FIG. 6, the spiral-wound tube is used for completing a zone in temporary manner. In a well in deep water, the problem may be due to too small a difference between the fracturing gradient and the pressure of the formation. There may alternatively be problems associated, for example, with the presence of formations that are highly unstable (clayey rock, sands, salts, etc.) in depletion zones, or other problems that are well known to the person skilled in the art. The financial consequences of such zones is generally out of all proportion to their length since anticipated completion thereof requires casing to be installed on an extra occasion, thereby reducing the diameter of the hole.

The well has been drilled and casing has been installed in its upper portion 1. Drilling has then continued beneath the casing shoe 2 to pierce a hole 3 that is substantially cylindrical, and that is not cased, prior to reaching a zone 4 of length Lz which needs to be treated immediately (FIG. 6*a*). The decision is taken to proceed with temporary completion using a liner of the invention. A spiral-wound liner 5 is pushed towards the bottom of the well by means of a double conical expansion tool 6 fixed at the end of a tube 7. The expansion tube is caused to move on (FIG. 6*b*) so as to spread apart the walls of the liner until they reach a predefined diameter (FIG. 6*c*). Once the liner is in place (FIG. 6*d*) the expansion tool is returned to the surface and the liner is cemented using liner cementing techniques (FIG. 6*e*). In the case shown here, the liner is provided with openings 8 to allow cement to pass from the inside of the liner towards the annulus 9 which is to be cemented, however it is clear that a cementing shoe could be used.

After expansion, the inside diameter of the liner is practically identical to the diameter of the hole in zones where there are no drilling problems (where necessary, the hole can be enlarged in the zone that requires treatment by means of a reamer). Drilling can then be started again without any need to drill through a cemented zone, and the entire well can be completed in accordance with the original drilling plan, and without any reduction in the diameter of the well.

It is clear that additional tools such as a centralizer could be used in combination with the liner of the invention. Also, the liner is preferably fitted with endpieces made of a material that is easily deformed and that is easy to drill (e.g. aluminum), thereby guaranteeing that the spiral-wound liner is properly expanded over its entire length.

A typical sequence of using a spiral-wound liner of the invention for completing a section of a reservoir is shown in FIG. 7. Such an operation may be envisaged, for example, with formations that are unstable or sandy.

The spiral-wound liner of the invention is brought in the contracted state to a non-cased section of the reservoir (FIG. 7*a*) and it is then expanded by means of an expansion tool (FIGS. 7*b* and 7*c*). Like any other production liner, the liner of the invention is, in this case, pierced to allow production fluids to pass therethrough, and as shown in FIG. 8, it is preferably covered in a grid which may be fixed thereto, e.g. by being welded to the strip prior to spiral winding. The grid is preferably on the outside face of the liner, facing towards the wall.

It should be observed that the surface area of the rolled-up strip remains unaltered during expansion so wells are not weakened by the spiral-wound liner of the invention being put into place and expanded. For the same reason, the size and distribution of the openings provided for allowing the production fluids to pass can be selected in a manner that is entirely independent of the diameters in the contracted state and in the expanded state. This makes it possible, in particular, to obtain a liner that is very strong in association with greater stability and longer life of the well.

For a horizontal well, a spiral-wound liner of the invention is particularly advantageous since it can be placed very close to the formation, even in the upper portion of the liner, and that is often not the case with a conventional liner that is incapable of being contracted.

So long as it has not been cemented, a spiral-wound liner can be withdrawn by means of a special tool which separates the longitudinal edges so as to allow the liner to roll up again and return to a state similar to that of its initial contracted state. If such withdrawal is expected only after several months or years, care should be taken to use a material that is capable of retaining its elastic properties over such a long period of time.

The geometry of the spiral-wound liner of the invention is entirely compatible with mass production at low cost. For example, it is possible to use metal strips (where necessary strips that are welded together) that are pierced in a predefined pattern, e.g. by punches mounted on rollers or by a hydraulic press having a punch. The longitudinal edges are preferably rectified continuously so as to give them a toothed profile, and grids may similarly be welded at least along one of the longitudinal edges before winding into a spiral. Finally, the strip may be spiral-wound directly and then coiled, either continuously or else after being cut up into equal lengths.

In general, it is preferable to pay out a liner of the invention from a reel since that is cheaper once the section to be completed is long, and more reliable since connections are omitted. Nevertheless, it is equally possible to use liners of fixed length and to perform completion in a zone by repeatedly placing and expanding lengths of liner.

What is claimed is:

1. A liner for completing a hole in an underground formation, the liner being constituted by a strip that, in a first position, is spiral-wound whereas its longitudinal edges form a certain angle relative to the axis of symmetry of said strip, and in a second expanded position, is circular in section and has its longitudinal edges defining a contact surface and having complementary touching profiles.

2. A liner for completing a hole in an underground formation, the liner being constituted by a spiral-wound strip, its longitudinal edges defining a contact surface having complementary touching profiles such that after expansion the liner is circular in section, characterised in that said contact surface is of general direction $\vec{D}$ lying in a plane that forms a non-zero angle relative to the longitudinal axis of the liner.

3. A liner according to claim 2, characterized in that said angle formed by the general direction $\vec{D}$ of the contact surface lies in the range 30° to 60°.

4. A liner according to claim 2, characterized in that the touching longitudinal edges have a sawtooth profile.

5. A liner according to claim 2, characterized in that it is provided with openings.

6. A liner according to claim 5, characterized in that it is covered in a grid.

7. A liner according to claim 6, characterized in that the grid is welded on.

8. A system for completing a hole in an underground formation, characterized in that it includes a liner according to claim 1 and an expansion tool suitable for splaying apart the longitudinal edges until they take up a position where they touch each other edge-to-edge.

9. A system for withdrawing a liner according to claim 1, characterized in that it includes a liner according to claim 1 and a tool for withdrawing said liner, the tool comprising means for moving the longitudinal edges apart by a diameter greater than the diameter comprising to a circular section and enabling the liner to shrink so as to return to a spiral-wound configuration of a diameter that is small enough to enable the liner to be extracted from the well.

* * * * *